US011047185B2

(12) United States Patent
Provost

(10) Patent No.: US 11,047,185 B2
(45) Date of Patent: Jun. 29, 2021

(54) HYDRAULIC SETTING TOOL INCLUDING A FLUID METERING FEATURE

(71) Applicant: Wilfred Provost, Tomball, TX (US)

(72) Inventor: Wilfred Provost, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 36 days.

(21) Appl. No.: 16/418,532

(22) Filed: May 21, 2019

(65) Prior Publication Data

US 2020/0370384 A1 Nov. 26, 2020

(51) Int. Cl.

| | |
|---|---|
| ***E21B 23/06*** | (2006.01) |
| ***E21B 23/04*** | (2006.01) |
| ***E21B 33/12*** | (2006.01) |

(52) U.S. Cl.

CPC ..... *E21B 23/06* (2013.01); *E21B 23/04* (2013.01); *E21B 33/12* (2013.01)

(58) Field of Classification Search

CPC ..... E21B 23/06; E21B 23/04; E21B 33/12
See application file for complete search history.

(56) References Cited

U.S. PATENT DOCUMENTS

| | | | |
|---|---|---|---|
| 6,782,952 | B2 | 8/2004 | Garay et al. |
| 7,510,013 | B2 | 3/2009 | Kimpel |
| 8,931,565 | B2 | 1/2015 | Desranleau et al. |
| 9,739,118 | B2 | 8/2017 | Halfmann et al. |
| 2010/0252252 | A1 | 10/2010 | Harris et al. |
| 2014/0246208 | A1 | 9/2014 | Themig et al. |
| 2017/0335656 | A1 | 11/2017 | Ross et al. |

FOREIGN PATENT DOCUMENTS

| | | | |
|---|---|---|---|
| EP | 2221448 | A2 | 8/2010 |
| WO | 2008121653 | A2 | 10/2008 |

OTHER PUBLICATIONS

Notification of Transmittal of the International Search Report and the Written Opinion of the International Searching Authority, or the Declaration; International Filing Date Apr. 17, 2020; dated Jul. 30, 2020; 13 pages.

*Primary Examiner* — Nicole Coy
*Assistant Examiner* — Yanick A Akaragwe
(74) *Attorney, Agent, or Firm* — Cantor Colburn LLP

(57) ABSTRACT

A setting tool for actuating a downhole component includes an inner tubular configured to be connected in fluid communication with a borehole string, a housing configured to define a first fluid chamber and a second fluid chamber isolated from the first fluid chamber and in fluid communication with the inner tubular, and a setting piston in pressure communication with the second fluid chamber. The setting tool includes a metering module coupled to the housing and disposed at an end of the first fluid chamber, the metering module including a fluid path forming a restriction therein, and an outlet connected to the fluid path. The outlet is configured to be opened to permit fluid to flow out of the first chamber at a controlled rate to generate a differential pressure between the first and second chambers that causes the setting piston to apply a gradually increasing force on the component.

20 Claims, 7 Drawing Sheets

HYDRAULIC SETTING TOOL INCLUDING A FLUID METERING FEATURE

BACKGROUND

Exploration and production of hydrocarbons require a number of diverse activities from various engineering fields to be performed in a borehole penetrating an earth formation. Typically, exploration involves surveying and performing measurements known as logging using a survey or logging tool. Production generally involves activities such as drilling, installing permanent installations, casing perforation, hydraulic fracturing, formation evaluation, well integrity surveys, well stimulation, production logging, pressure pumping and cement evaluation.

There are a variety of tools and components that are actuated downhole to perform various functions. For example, packer assemblies are often used to isolate sections of a borehole and surrounding formation regions. Packer assemblies and other tools can be actuated in various ways, such as by electric, hydraulic and/or mechanical means. For example, a setting tool can be used for mechanical actuation of a packer assembly or other component. Some packer setting tools include a piston or other device that moves axially to apply an axial force on packer elements and cause the elements to expand or extend radially against a borehole wall or casing.

SUMMARY

An embodiment of a setting tool configured to actuate a downhole component includes an elongated inner tubular configured to be connected in fluid communication with a borehole string in a borehole in a resource bearing formation, a housing configured to define a first fluid chamber and a second fluid chamber therein, the first fluid chamber configured to be filled with a fluid, the second fluid chamber isolated from the first fluid chamber and in fluid communication with the inner tubular, and a setting piston coupled to the housing and in pressure communication with the second fluid chamber. The setting tool also includes a metering module coupled to the housing and disposed at an end of the first fluid chamber, the metering module including a fluid path in fluid communication with the first fluid chamber, the fluid path forming a restriction therein, and an outlet connected to the fluid path, the outlet configured to permit fluid in the first fluid chamber to exit the first fluid chamber. The outlet is configured to be opened to permit fluid to flow out of the first chamber at a flow rate controlled by the restriction and reduce fluid pressure therein to generate a differential pressure between the first chamber and the second chamber, the differential pressure causing the setting piston to apply a gradually increasing force on the downhole component.

An embodiment of a method of actuating a downhole component includes deploying a borehole string including the downhole component and a setting tool in a borehole in a resource bearing formation. The setting tool includes an elongated inner tubular in fluid communication with the borehole string, a housing configured to define a first fluid chamber and a second fluid chamber therein, the first fluid chamber filled with a fluid, the second fluid chamber isolated from the first fluid chamber and in fluid communication with the inner tubular, and a setting piston coupled to the housing and in pressure communication with the second fluid chamber. The setting tool also includes a metering module coupled to the housing and disposed at an end of the first fluid chamber, the metering module including a fluid path in fluid communication with the first fluid chamber, the fluid path forming a restriction therein, and an outlet connected to the fluid path, the outlet configured to permit fluid in the first fluid chamber to exit the first fluid chamber. The method includes circulating borehole fluid through the borehole string and an annulus of the borehole, increasing fluid pressure in the inner tubular and opening the outlet, where opening the outlet permits fluid to flow out of the first chamber at a flow rate controlled by the restriction and reduce fluid pressure in the first chamber, and generating a differential pressure between the first chamber and the second chamber due to a decrease in fluid pressure in the first chamber, the differential pressure causing the setting piston to apply a gradually increasing force on the downhole component.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
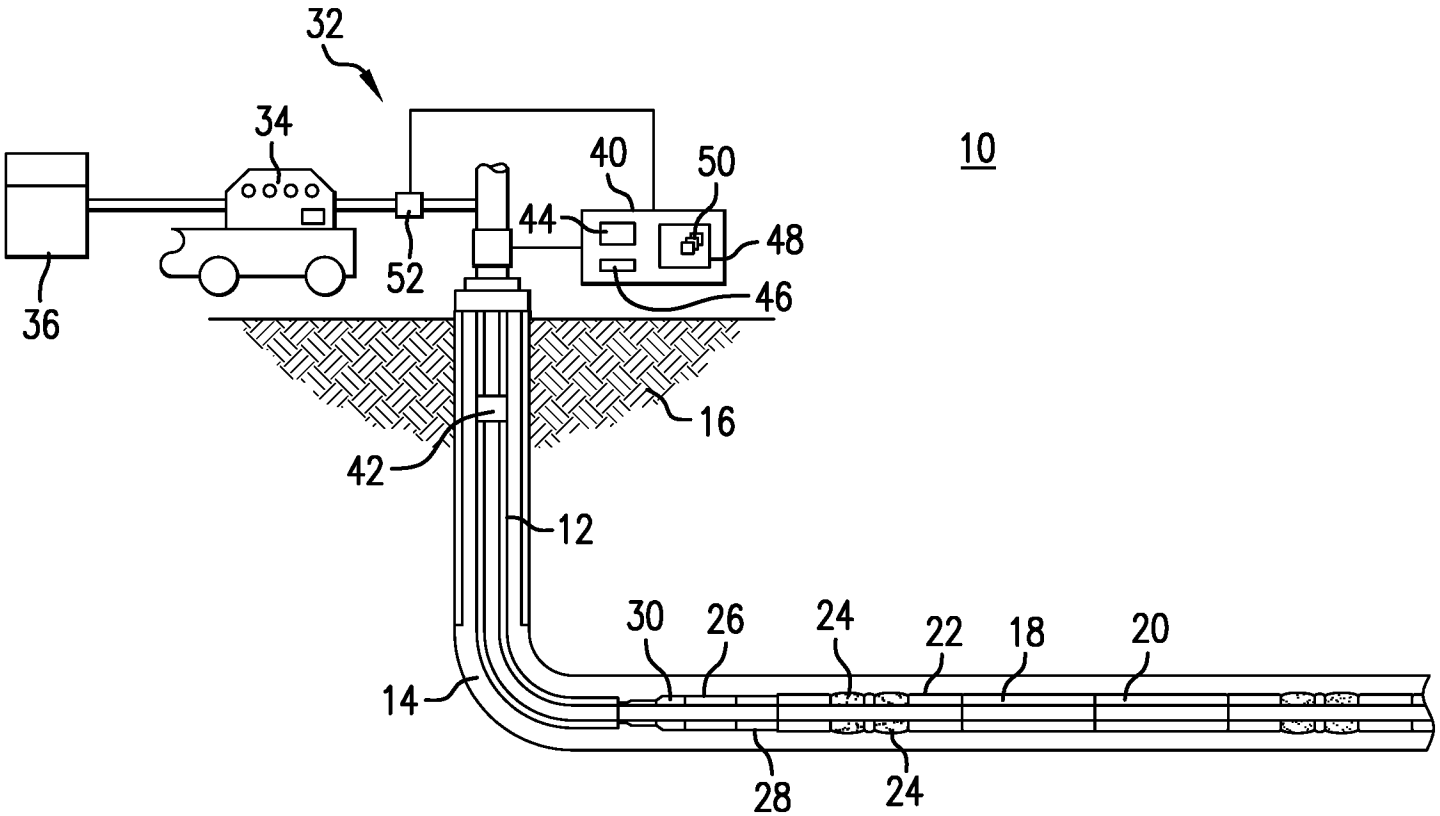
FIG. 1 illustrates an embodiment of a system for performing energy industry operations.

A detailed description of one or more embodiments of the disclosed apparatus and method presented herein by way of exemplification and not limitation with reference to the figures.

Systems, devices and methods are provided herein for actuating or operating downhole components. An embodiment of a setting device or assembly (also referred to as a setting tool) includes an actuation or setting piston configured to be moved axially by hydraulic pressure to apply a selected force to a downhole component to actuate the component. In one embodiment, the setting device is configured to actuate a packer device.

An embodiment of the setting device includes an elongated inner tubular in fluid communication with a borehole string, and an actuation assembly. The actuation assembly includes a housing, a setting piston or other mechanical actuator, and a metering module, which are all moveable in axial directions along the tubular. The housing extends axially along the tubular and defines one or more fluid chambers therein. Fluid pressure is applied to one or more fluid chambers, which in turn applies pressure to the setting piston. The setting piston applies a corresponding actuation force to the downhole component to actuate the downhole component. The metering module includes a fluid path configured as a restriction, which allows fluid in one chamber to gradually bleed into an annular region of the borehole. This gradual bleeding of fluid causes fluid pressure opposing the setting piston to decrease gradually or otherwise in a controlled manner, and thereby causes the setting piston to apply a gradually increasing amount of force on the downhole component.

In one embodiment, the housing defines first and second opposing fluid chambers that are isolated from each other. The first chamber and the second chamber are separated by a pressure piston or other component that is fixedly disposed relative to the tubular. The setting piston or other mechanical actuator is disposed at an end of the second chamber, so that the pressure piston and the setting piston define opposing ends of the second chamber. The pressure piston and the metering module is disposed at an end of the first chamber, so that the pressure piston and the metering module define opposing ends of the first chamber.

The metering module, in one embodiment, includes an outlet to an annular region of the borehole, which may be initially closed to prevent egress of fluid from the first chamber. The outlet may be opened by applying sufficient pressure to rupture a rupture disk, open a valve or otherwise establish fluid communication between the first chamber and the annular region. As a result, fluid gradually bleeds into the annular region, resulting in a gradually increasing pressure differential between the first chamber and the second chamber. The gradually increasing pressure differential translates to a gradually increasing amount of force applied by the setting piston.

Embodiments described herein provide a number of advantages and technical effects. For example, embodiments provide for a gradual or controlled increase of hydraulic pressure on an actuator, which allows for a controlled or gradual increase in force applied by the actuator. This feature is advantageous, for example, in systems that have components that are actuated by different levels of force. Instead of having to actively control the amount of fluid pressure applied by circulating fluid, a single pressure can be maintained in the borehole string and inner tubular to cause sequential application of force amounts. The embodiments ensure that components that are actuated at different pressures are actuated in the desired order.

FIG. 1 illustrates an embodiment of a system 10 for performing energy industry operations. The system 10, in the embodiment of FIG. 1, is a completion and hydrocarbon production system 10. The system 10 is not so limited, and may be configured to perform any energy industry operation, such as a drilling, stimulation, measurement and/or production operation, or any other operation related to exploration and/or recovery of resources such as oil and gas.

A borehole string 12 including, e.g., a completion string, is configured to be disposed in a borehole 14 that penetrates a resource bearing formation 16 or formation region. The borehole 14 may be an open hole, a cased hole or a partially cased hole. The borehole string 12 may be configured for various uses, such as drilling, completion, stimulation and others, and includes a tubular, such as a coiled tubing, pipe (e.g., multiple pipe segments) or wired pipe, that extends from a wellhead at a surface location (e.g., at a drill site or offshore stimulation vessel). As described herein, a "string" refers to any structure or carrier suitable for lowering a tool or other component through a borehole or connecting a drill bit to the surface, and is not limited to the structure and configuration described herein.

In one embodiment, the borehole string 12 includes a completion and production string configured to be deployed in the borehole 14 to install various components at selected locations to facilitate completion of the borehole 14 or sections thereof. For example, the borehole string 12 includes a completion string having a production assembly 18 including a fracture or "frac" sleeve device, and/or a screen assembly 20. The borehole string 12 also includes one or more packer assemblies 22. Each packer assembly includes one or more packer elements 24, which are made from rubber or other suitable deformable material. The packer elements 24 are configured to be actuated by applying an axial force thereto, which causes the packer elements 24 to compress and extend radially into the borehole 14 to isolate components and/or zones in the borehole 12. For example, multiple packer assemblies 22 can be used to establish production zones around the borehole 12.

The borehole string 12 also includes at least one setting assembly or device, which is referred to herein as a setting tool 26. The borehole string 12 can include one setting tool 26 for actuation of both packer assemblies 22, or multiple setting tools 26 for actuation of respective packer assemblies 22.

Each setting tool 26 is operated hydraulically by applying fluid pressure thereto. In one embodiment, the setting tool 26 includes an actuator 28 that is caused to move axially along an inner tubular toward the packer assembly 22. The setting tool 26 also includes a metering module 30 that controllably or gradually meters fluid from the setting tool 26 into an annular region of the borehole 14, so as to apply a gradually increasing amount of force on the packer assembly 22, as discussed in further detail below.

In one embodiment, the fluid pressure is applied to the setting tool 26 via fluid injected into the borehole 14 (i.e., borehole fluid) by surface equipment 32. The surface equipment 32 includes components such as a drill rig, rotary table, top drive and/or others to facilitate deploying the borehole string 12, operating various downhole components, monitoring downhole conditions and controlling fluid circulation through the borehole 14 and the borehole string 12. In one embodiment, the surface equipment 32 includes an injection device such as a pump 34 in fluid communication with a fluid tank 36 or other fluid source. The pump 34 facilitates injection of fluids, such as drilling fluid (e.g., drilling mud), stimulation fluid (e.g., a hydraulic fracturing fluid), gravel slurries, proppant and others.

In one embodiment, the system 10 includes a processing device such as a surface processing unit 40, and/or a subsurface processing unit 42 disposed in the borehole 14 and connected to one or more downhole components. The processing device may be configured to perform functions such as controlling drilling and steering, controlling downhole components, transmitting and receiving data, processing measurement data and/or monitoring operations. In addition, the processing device may control aspects of fluid circulation, such as fluid pressure and/or flow rate into the borehole string 12.

The surface processing unit 40, in one embodiment, includes a processor 44, an input/output device 46 and a data storage device (or a computer-readable medium) 48 for storing data, files, models, data analysis modules and/or computer programs. For example, the storage device 48 stores processing modules 50 for performing functions such as controlling fluid circulation, controlling the setting tool 26 and downhole components, collecting data, communicating with downhole components, storing data, and/or performing data analysis.

Various sensors and/or measurement tools may be included in the system 10 at surface and/or downhole locations. For example, one or more flow rate and/or pressure sensors 52 may be disposed in fluid communication with the pump 34 and the borehole string 12 for measurement of fluid characteristics. The sensors 52 may be positioned at any suitable location, such as proximate to or within the pump 34, at or near the surface, or at any other location along the borehole string 12 or the borehole 14.

Figure 2:
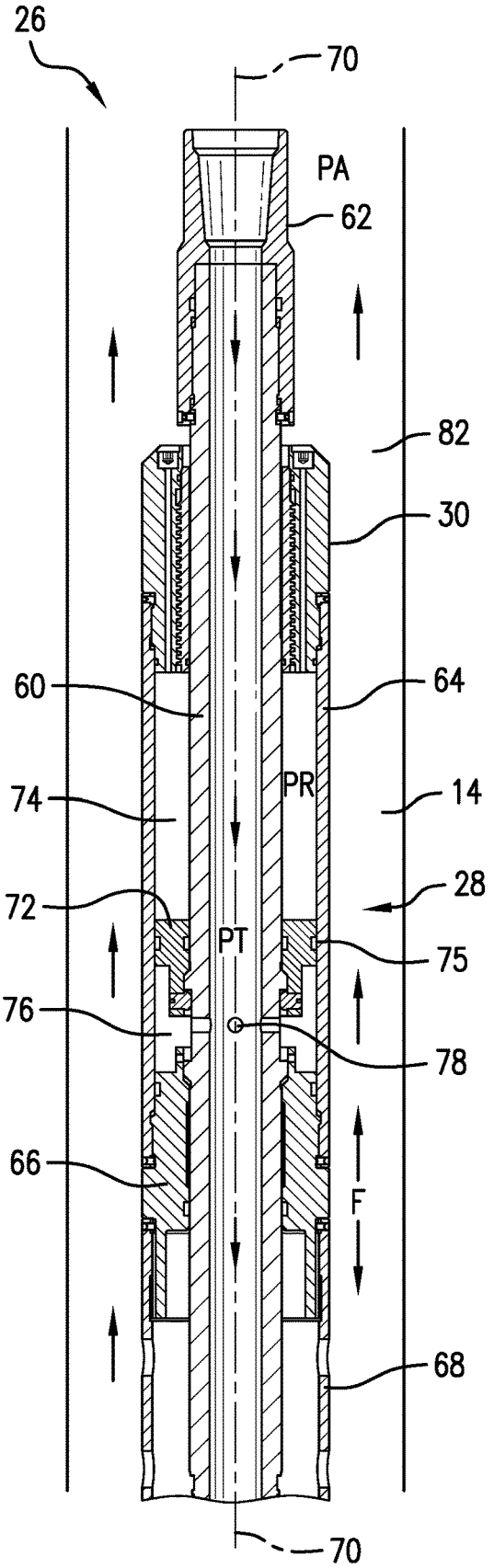
FIG. 2 depicts an embodiment of a setting tool configured to actuate a downhole component, the setting tool including a metering module.

FIG. 2 shows an embodiment of the setting tool 26, which includes a fluid conduit defined by an inner tubular 60. The tubular 60 is connected in fluid communication a source of fluid. For example, the tubular 60 is connected via a coupler 62 to a fluid conduit in the borehole string 12.

The setting tool 26 includes an actuation assembly including a cylindrical housing 64, the actuator 28 and the metering module 30, all of which are moveable axially as a single unit. The housing 64 surrounds the tubular 60 and defines an annular space around the tubular 60. In this embodiment, the actuator 28 includes a setting piston 66 fixedly attached to the housing 64, and a force application sleeve 68 fixedly attached to the housing 64 and the setting piston 66. The metering module 30 is fixedly attached to the housing 64. The metering module 30, the housing 64, the setting piston 66 and the force application sleeve 68 are all moveable together in axial directions parallel to a longitudinal axis 70.

In one embodiment, a fixed dividing component 72 is disposed within the housing 64 and divides the interior of the housing 64 around the tubular 60 into opposing fluid chambers. The dividing component 72 is fixedly disposed relative to the tubular 60, so that, as the actuation assembly moves, the dividing component 72 remains fixed.

In one embodiment, the dividing component 72 is configured as a pressure piston 72 disposed within the housing 64 and fixed relative to the tubular 60, so that when the actuation assembly moves axially relative to the tubular 60, the pressure piston 72 remains fixed relative to the tubular 60. The pressure piston 72 has a body that extends radially from the tubular to an interior surface of the housing 64 to divide the annular space into opposing fluid chambers 74 and 76. An o-ring 75 or other suitable sealing feature allows the housing 64 to slide along the tubular 60 while maintaining a fluid tight seal between the fluid chambers 74 and 76.

In one embodiment, the first fluid chamber 74 is configured to be filled with fluid (e.g., borehole fluid) to a selected pressure (e.g., 15 psi or less), and is initially isolated from the tubular 60, the second fluid chamber 76 and the annular region of the borehole 14 (also referred to as the annulus). The second fluid chamber 76 is in fluid communication with the tubular 60 via a through hole 78 or other suitable feature. In one embodiment, the second fluid chamber 76 is continually in fluid communication with the tubular 60 as the setting tool 26 is operated.

In an initial configuration, the first chamber 74 is filled with fluid to a selected pressure ($P_R$), which in one embodiment is at or near a run-in pressure. A run-in pressure is a pressure that corresponds to fluid pressure in the tubular 60 and/or the annulus during deployment of the borehole string 12 and prior to activation of the setting tool 26. As the setting tool 26 is deployed in a borehole, fluid is circulated through the borehole string 12 and the tubular 60, and the second fluid chamber 76 is pressurized. During deployment and prior to initiation of the setting tool 26, the pressure $P_R$ in the first fluid chamber 76 is generally equal to the pressure in the tubular 60 and the second fluid chamber 76 ($P_T$) by virtue of axial movement of the housing 64 and the metering module 30 relative to the pressure piston 72.

The metering module 30 is configured to be opened when operation of the setting tool 26 is initiated. As discussed further below, the metering module 30 is configured to release fluid from the first chamber 74 in a controlled manner, i.e., meter fluid, so that the differential pressure between the chambers 74 and 76 is gradually increased from about zero to an amount sufficient to apply an amount of force needed to actuate a downhole component. As the force increases, components that are actuated by increasing amounts of force can be actuated in sequential order.

To activate the setting tool 26, pressure in the tubular 60 is increased (e.g., using the pump 34) to an initiation pressure, which is the pressure needed to actuate a component. If multiple components are actuated at different pressures, the initiation pressure is the highest pressure needed to actuate one of the components. As discussed further below, the initiation pressure can be maintained in the tubular 60 during activation of the setting tool 26. When the metering module 30 is opened and fluid begins to bleed into the annulus, an axial force (F) applied by the setting piston 66 increases gradually and thereby actuates the downhole components in an order corresponding to the pressure needed to actuate each component.

For example, the downhole component connected to the setting tool 26 can be a packer device such as the packer assembly 22 of FIG. 1. The packer assembly 22 includes slips (not shown) and the packer elements 24. The packer assembly 22 is actuated by applying a first amount of force to cause the slips to move radially and grip the borehole wall, and by subsequently applying a second and greater amount of force to set the packer elements 24. As force is applied by the setting piston 66 in increasing amounts, the slips and the packer elements 24 are actuated in a sequential manner, i.e., the packer slips are actuated at a lower pressure and subsequently the packer elements 24 are actuated at a higher pressure.

In one embodiment, the metering module 30 includes a metering assembly having an outlet 80 (shown in FIG. 3) that connects the first chamber 74 to an annular region or annulus 82 of the borehole 14. The metering assembly also includes a fluid path that connects the first chamber 74 to the outlet 80. The fluid path forms a restriction that allows fluid to be gradually released from the first chamber 74, which results in a gradual reduction of fluid pressure in the first chamber 74. In this way, the differential pressure between the first chamber 74 and the second chamber 76 increases at a controlled rate that is related to the rate of fluid flow from the first chamber 74.

In one embodiment, the restriction is formed by a helical metering assembly or configuration. An example of such an assembly or configuration is shown in FIGS. 2-6.

Figure 3:
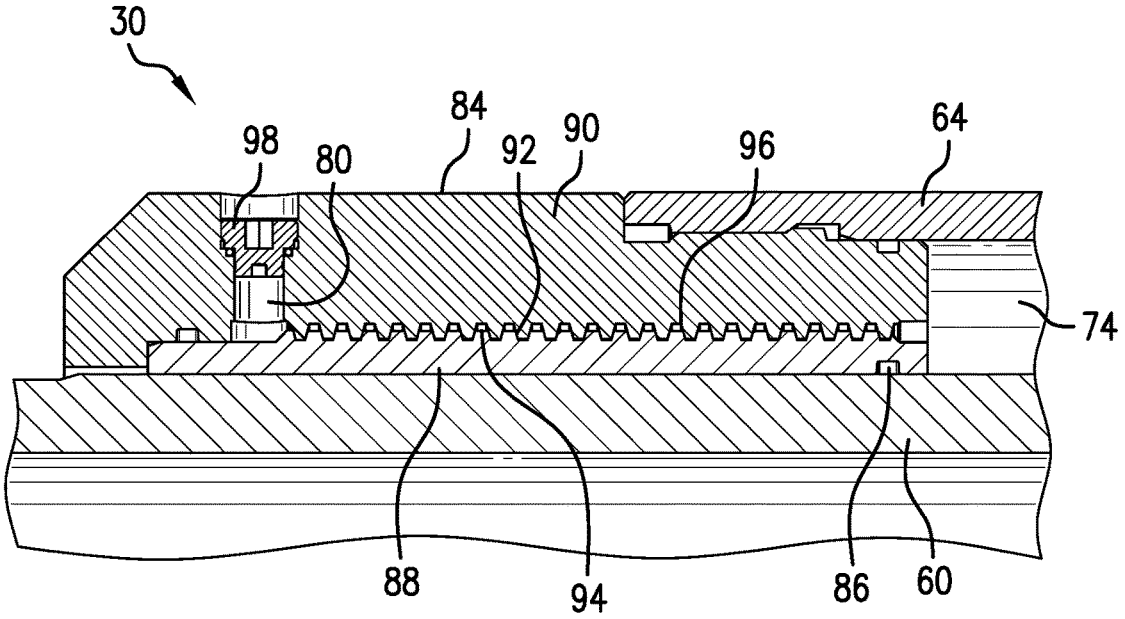
FIG. 3 is a cross-sectional view of a portion of the metering tool of FIG. 2, which includes a metering module and a rupture disk.

Referring to FIG. 3, the metering module 30 includes a body 84 that is fixedly attached to the housing 64, so that the metering module 30 moves along the tubular 60 with the housing 64. The metering module body 84, the housing 64 and the pressure piston 72, in this example, define the first chamber 74. The metering module 30 may include an o-ring 86 or other suitable sealing feature that allows the metering module 30 to slide along the tubular 60 while maintaining a fluid tight seal between the metering module 30 and the tubular 60.

In this example, the metering module 30 includes a helical restriction path that is formed by an inner body portion 88 and an outer body portion 90. The outer body portion 90 includes a set of helical threads 92 at an interior (i.e., toward the tubular 60) surface thereof. The inner body portion 88 has a set of threads 94 on an exterior (i.e., toward the annulus 82) surface thereof. The sets of threads 92 and 94 interconnect to form a helical restriction path 96 that extends from the first chamber 74 to the outlet 80.

The restriction is configured to allow fluid to flow into the annulus 82 at a selected flow rate (metering rate). The metering rate can be controlled in any suitable manner. For example, the threads 92 and/or 94 are truncated to establish a preselected distance between the threads and a corresponding volume of fluid that can be accommodated in the restriction path 96.

In this embodiment, the set of threads 92 and/or 94 are truncated to form a space between opposing threads. This space forms the helical path. It is noted that the restriction and the metering module 30 are not limited to the embodiments described herein. For example, the metering module 30 can be a unitary body with a restriction path formed therein. The restriction path can be helical, linear, nonlinear or otherwise have any configuration that restricts fluid flow to a selected rate.

In one embodiment, the outlet 80 can be opened to initiate actuation by increasing the pressure at which fluid is circulated through the borehole 14. For example, the outlet 80 includes a valve, rupture disk, shearable piston or other feature or device that opens in response to a selected pressure, such as a differential pressure between the annulus 82 and the first chamber 74 that results from pressurizing the tubular 60 to an initiation pressure. As described herein, an initiation pressure is a fluid pressure in the tubular 60 that is sufficient to cause the setting tool 26 to actuate a downhole component.

Referring again to FIG. 3, in one embodiment, the outlet 80 is formed within the outer body portion 90 and includes a rupture disk 98 configured to prevent fluid flow from the first chamber 74 to the annulus 82 until a sufficient differential pressure is applied across the rupture disk 98. The rupture disk 98 can be configured to burst in response to fluid pressure being increased from the surface to a selected pressure or pressure range. The pressure or pressure range may be, for example, above the run-in pressure and at or below the initiation pressure. For example, the rupture disk 98 is configured so that it ruptures upon increasing the pressure in the tubular 60 to the initiation pressure (e.g., about 4,000 psi, which is the pressure needed to actuate the packer elements 24).

Figure 4:
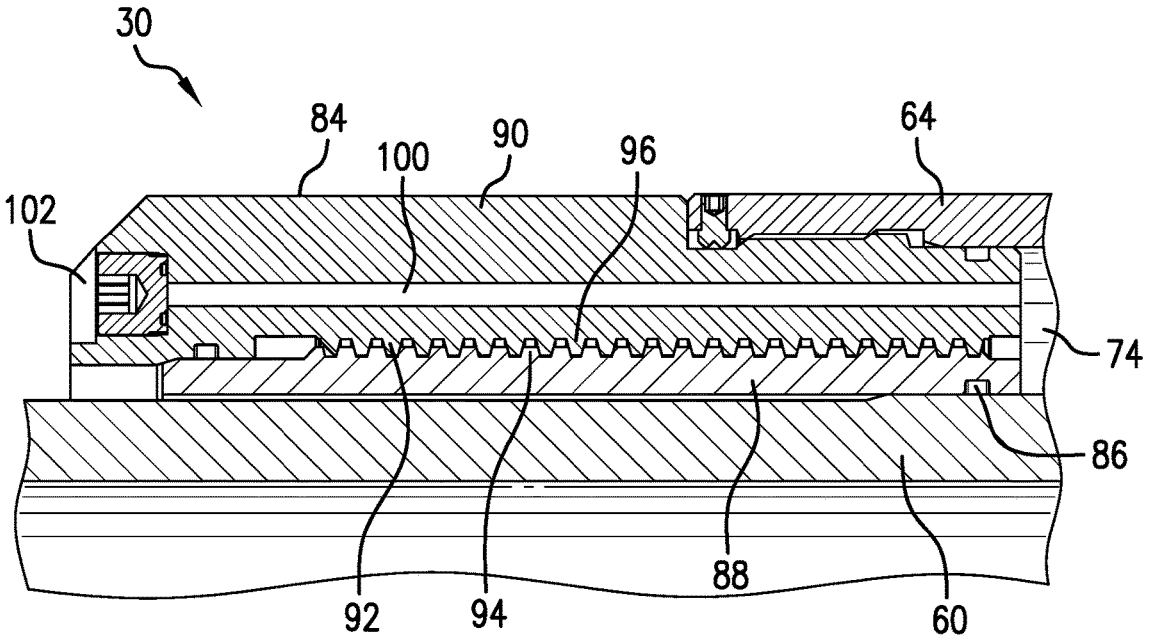
FIG. 4 is a cross-sectional view of a portion of the metering module of FIGS. 2 and 3, which includes a filling and/or bleeding assembly.
Figure 5:
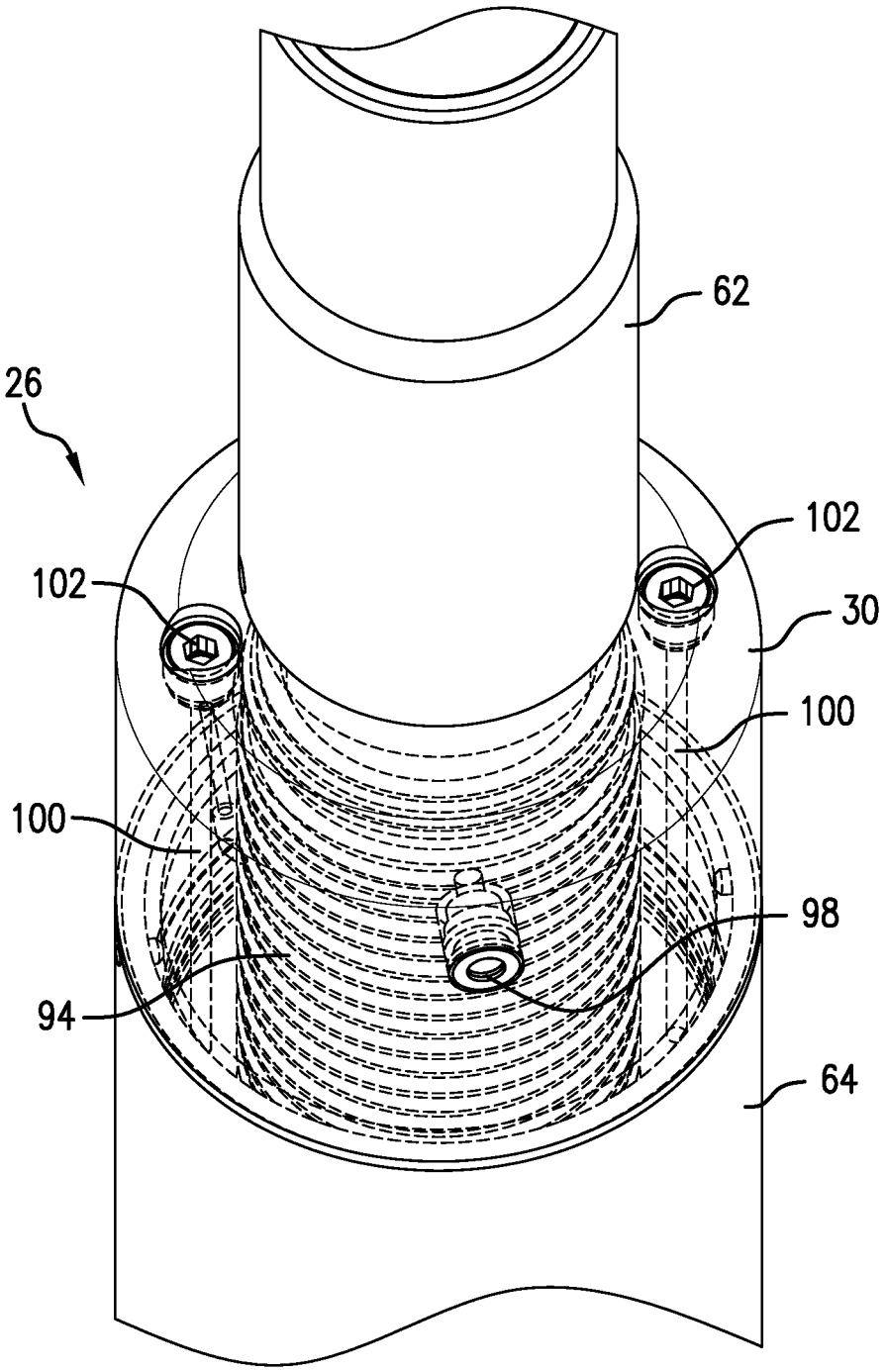
FIG. 5 is a perspective view of the metering module of FIGS. 2-4.

The metering module 30 may include other features to facilitate pressurizing and/or maintaining pressure in the first chamber 74. For example, as shown in FIGS. 4 and 5, the metering module body (e.g., the outer body 90) includes a fluid path 100 that extends to a filling and/or bleeding plug 102. The plug 102 can be opened to allow the first chamber 74 to be pressurized, and may also include a relief valve or other feature that permits fluid to bleed into the annulus 82 to maintain a pressure differential. For example, the plug 102 is configured to release fluid if pressure in the first fluid chamber 74 exceeds a threshold pressure, so that thermal expansion of fluid in the first fluid chamber 74 does not activate the outlet 80 or rupture disk 98 prematurely.

Although the embodiments of FIGS. 1-5 are configured to actuate in response to a pressure increase, they are not so limited. For example, the outlet 80 can be opened by any other suitable device or feature, such as a ball drop, a signal (e.g., acoustic, electric, etc.) or a mechanical force (e.g., applied torque).

Figure 6:
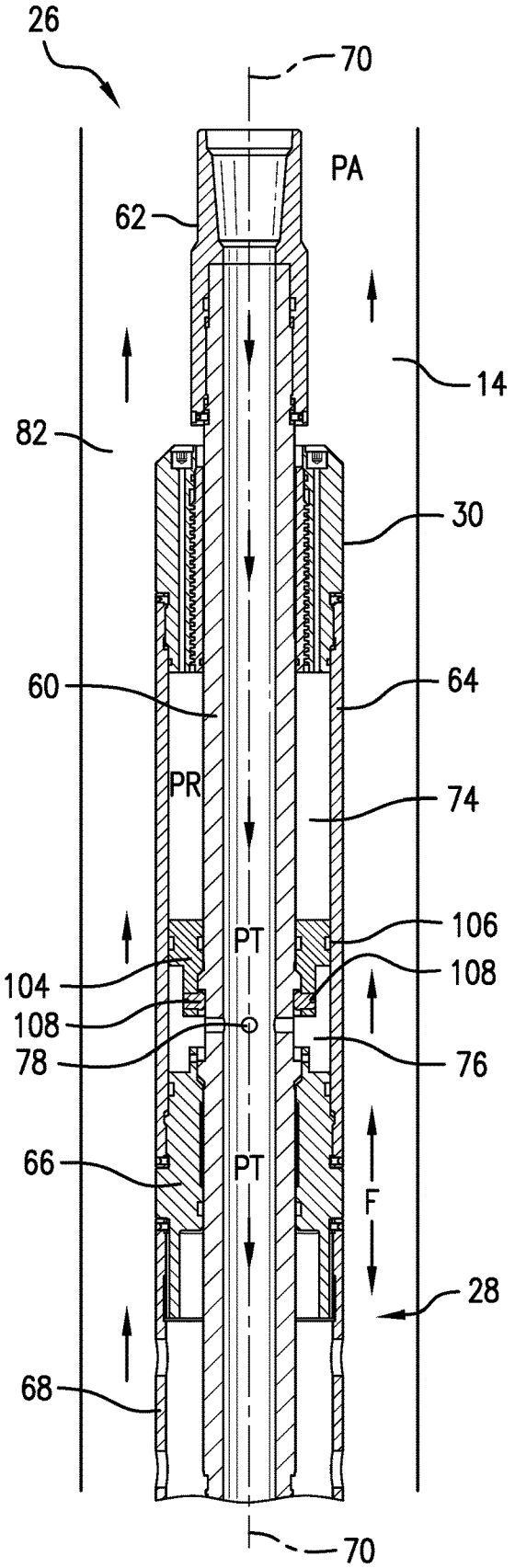
FIG. 6 depicts an embodiment of a setting tool configured to actuate a downhole component, the setting tool including a metering module.

FIG. 6 shows another embodiment of the setting tool 26. In this embodiment, the fixed dividing component is configured as a neutralizing piston 104. The neutralizing piston 104 is affixed to the tubular 60 and includes an o-ring 106 or other sealing feature that allows the housing 60 to slide along the neutralizing piston 104 while maintaining fluid isolation between the chambers 74 and 76.

The neutralizing piston 104 includes a releasing mechanism that can be actuated to release the neutralizing piston 104 after the packer assembly 22 has been actuated and remove any substantial force on the setting piston 66. For example, the neutralizing piston includes one or more shear screws 108 configured to shear and release the neutralizing piston when a selected pressure (release pressure) is applied to the tubular 60. In one embodiment, the release pressure is selected to be higher than the initiation pressure so that pressure in the tubular 60 can be increased after actuation to release the neutralizing piston 104. When the neutralizing piston 104 is released, it is free to move axially, which removes the force applied to the setting piston 66. This is useful, for example, for preventing damage to the packer assembly 22 or other tools.

Figure 7:
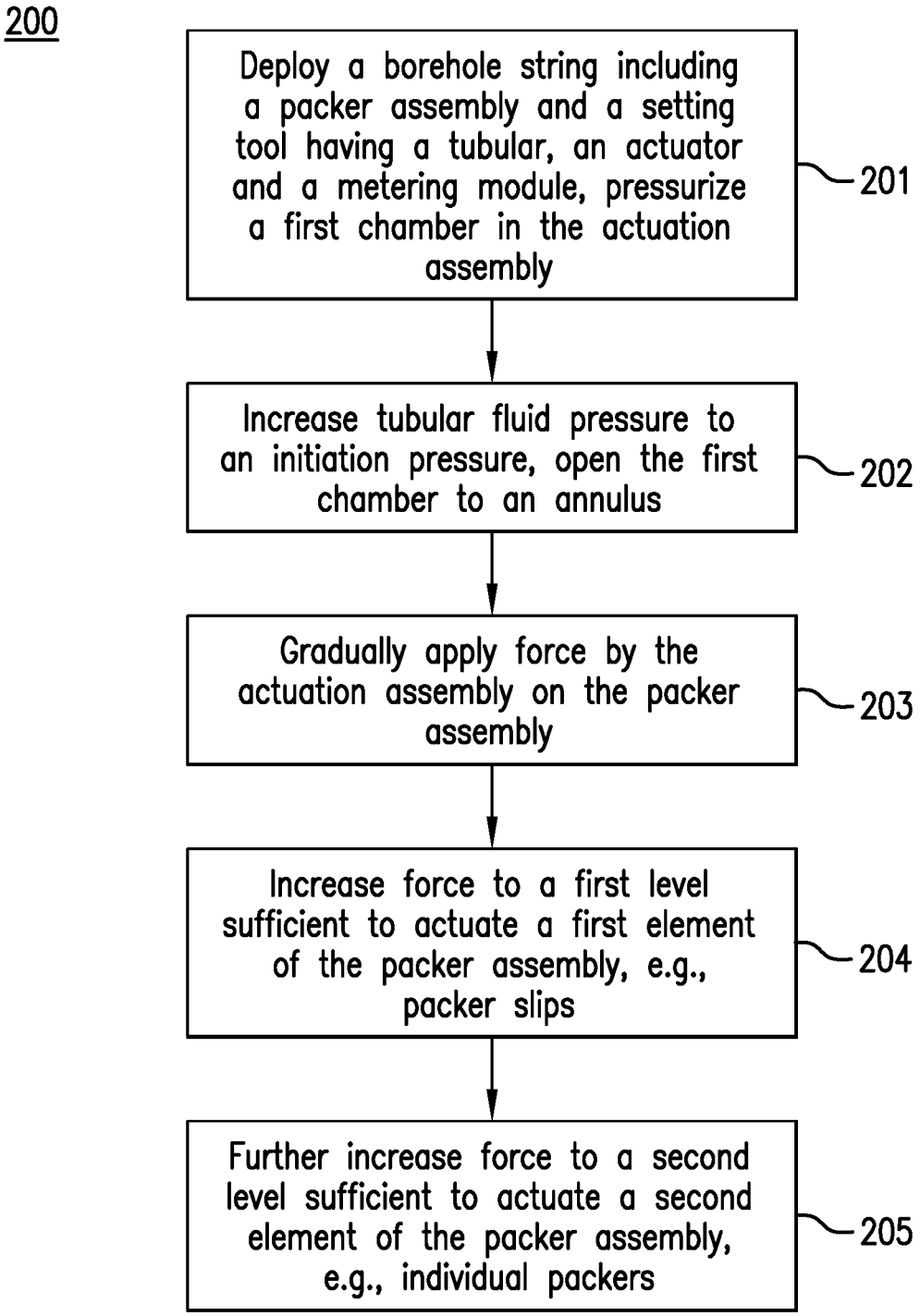
FIG. 7 is a flow chart depicting an embodiment of a method of actuating a downhole component.

FIG. 7 is a flow chart that illustrates an embodiment of a method 200 for actuating a downhole component or tool using a hydraulically activated setting tool. In this embodiment, all or part of the method 200 is performed by one or more processing devices, such as the surface processing unit 40, either alone or in conjunction with a human operator. The method 200 is discussed in conjunction with the system 10 of FIG. 1, and with the setting tool 26 of FIG. 6, but is not so limited.

The method 200 includes one or more stages 201-105. In one embodiment, the method 200 includes the execution of all of the stages 201-205 in the order described. However, certain stages may be omitted, stages may be added, or the order of the stages changed.

In the first stage 201, an energy industry operation, such as a completion operation, is performed. Prior to deployment, or at least prior to activating the setting tool 26, the first chamber 74 is initially pressurized by filling the first chamber 74 so that fluid pressure $P_R$ in the first chamber 74 is approximately equal to a selected pressure. The first chamber 74 may be filled through one or more of the fluid conduits 100.

In one embodiment, the first chamber 74 is filled with fluid to, e.g., a pressure at or near a selected pressure, such as a pressure that is below the rupture pressure of the rupture disk 98 and/or a pressure that is at or near the pressure applied to the tubular 60 during deployment (the run-in pressure). As noted above, the pressure $P_R$ in the first chamber 74 is maintained at or near the run-in pressure during deployment and prior to initiation of the setting tool 26. The run-in pressure may be any suitable pressure that is below the pressure used to activate the setting tool (the initiation pressure). For example, the first chamber 74 is pressurized to about 1,000 psi.

The borehole string 12 is deployed into the borehole 14 and advanced to a selected depth or location along the borehole 14. Drilling mud and/or other fluids (borehole fluid) are circulated through the borehole string 12 and the tubular 60 using, e.g., the pump 34. The borehole fluid is applied to the tubular 60 at the run-in pressure as the borehole 12 is deployed in the borehole 14. At this point, the fluid pressure $P_R$ in the second chamber 76 is approximately equal to the tubular pressure $P_T$.

In the second stage 202, pressure from the pump 34 is increased to a selected initiation pressure. In one embodiment, if multiple components are actuated at different pressures, the highest pressure needed to actuate a component is selected as the initiation pressure. For example, the initiation pressure is selected to be about 4,000 psi, which is the pressure needed to apply a sufficient force to actuate the packer elements 24. In some embodiments, the pressure in the tubular 60 can be maintained at the initiation pressure through actuation of all of the downhole components.

When the tubing pressure $P_T$ reaches the initiation pressure, differential pressure between the first chamber pressure $P_R$ and the annulus fluid pressure (PA) is sufficient to rupture the rupture disk 98 and open the first chamber 74 to the annulus 82. The flow rate out of the chamber 74 is restricted by the restriction 96, so that the initial output force (F) of the setting piston 66 is near zero.

In the third stage 203, as fluid from the first chamber 74 gradually enters the annulus 82, differential pressure between the first chamber 74 and the second chamber 76 increases, which acts against both the setting piston 66 and the pressure piston 72. As the differential pressure increases, the actuation assembly including the setting piston 66 and the actuator sleeve 68 move axially to engage the packer assembly 22 and apply a gradually increasing force on the packer assembly 22.

As the setting piston 66 strokes and makes contact with the packer assembly 22 (or otherwise engages the packer assembly), reaction force stops the setting piston 66, allowing pressure in the first chamber 74 to drop until the pressure differential generates a net force on the setting piston 66 sufficient to actuate a packer shear force event.

In the fourth stage 204, when the differential pressure reaches a first level, the force acting on the packer assembly 22 actuates one or more components. For example, as the force F increases to a first level, the actuation assembly causes a first shear event to activate slips in the packer assembly 22.

In the fifth stage 205, the force F gradually increases again as fluid bleeds from the first chamber 74, until the force F reaches a second level sufficient to activate the packer elements 24. In this manner, force is gradually applied to set all shear force events in the correct sequence.

The method 200 is not limited to use with a completion operation, and can be use in a variety of energy industry operations. Examples of such operations include drilling operations, LWD operations, wireline operations, stimulation operations and others.

FIG. 7 illustrates the relationship between fluid pressure in the tubular 60 and the second chamber 76 ($P_T$), fluid pressure in the first chamber 74 ($P_R$) and force F applied by the actuation assembly as the setting tool 26 is operated. $P_T$ is represented by curve 212, $P_R$ is represented by curve 214, and F is represented by curve 216.

As shown in the graph 210, between times A and B, the borehole string 12 is deployed at a run-in pressure of around 1,000 psi. At this point, $P_T$ is about the same as $P_R$. At time B, pressure is applied from the surface to increase tubular pressure $P_T$ to an initiation pressure of about 4,000 psi. At time C, when the tubular pressure $P_T$ reaches the initiation pressure, the rupture disk 98 ruptures to open the first chamber 74 to the annulus 82. Fluid in the first chamber 74 gradually flows into the annulus 82, thereby gradually increasing the pressure differential between $P_T$ and $P_R$ and moving the setting piston 66 against the packer assembly 22. The force F increases with increases in the pressure differential until the force F reaches a level sufficient to activate slips in the packer assembly at time D. As the slips move, the force F on the packer assembly 22 drops, allowing the setting piston 66 to move further and reduce the volume of the first chamber 74, which causes an increase in the pressure $P_R$. As tubular pressure $P_T$ remains relatively steady, the pressure $P_R$ drops again and the force F gradually increases until it is sufficient to actuate the packer elements 24 at time E. If the neutralizing piston 104 is used, the pressure $P_T$ can be increased to a higher pressure (e.g., 5,000 psi) to shear the shear screws 108 and release the neutralizing piston 104.

Figure 8:
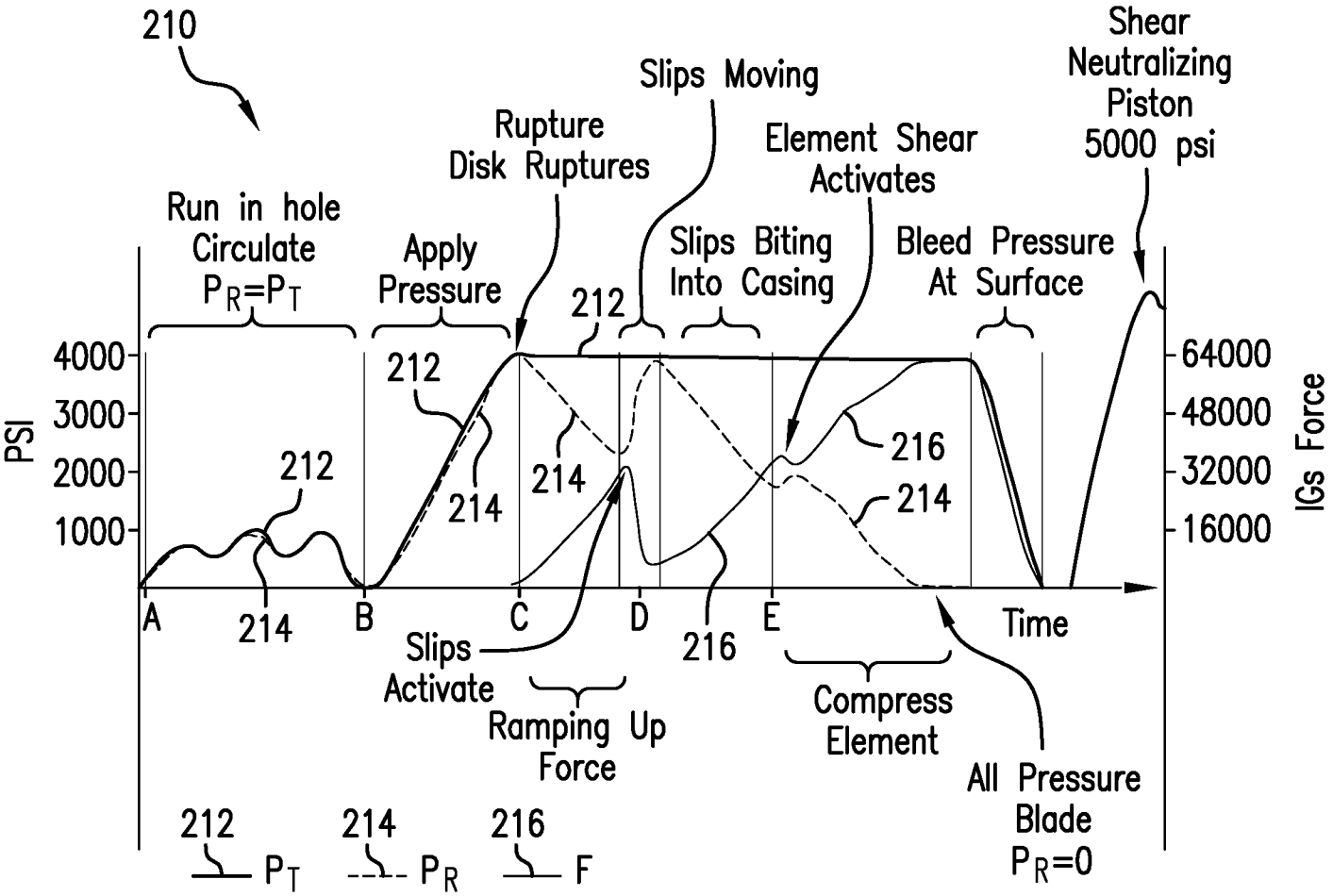
FIG. 8 is a graph depicting the relationship between tubular pressure and force during the method of FIG. 7.

As shown in FIG. 8, the tubular pressure $P_T$ can be maintained at a substantially constant level through the tubular 60, while allowing the setting piston 60 to move slowly and apply a gradually ramping force to the packer so that all shear force events occur in proper sequence. The actuation process is simplified as compared to other hydraulic activation techniques, which typically require that the pressure applied to a borehole string be sequentially increased.

Embodiments described herein present numerous advantages. For example, actuation of components can be accomplished without the need to manually increase and lower tubular pressure from the surface, which simplifies actuation. In addition, no additional actuation methods need to be introduced, such as ball drops on segmented ball seats, acoustic telemetry, atmospheric chambers with fragile pipettes, or RFID. This provides a less complex and easier way to control actuation of components.

In addition, the setting tool 26 allows for initiation at a relatively high pressure, which causes the setting tool 26 to slowly ramp up force to actuate components in a desired sequence. This provides the ability to set sand control packers and/or other devices where multiple actuation events occur at different force levels along the same actuation load path.

For example, some downhole components, such as the packer assembly 22, require several different forces that are applied in sequence to actuate the downhole component. Typically, to actuate such a component hydraulically, several different pressures are applied at surface to a downhole piston, beginning with the lowest and proceeding to the highest.

Using embodiments described herein, a setting tool can be operated by applying an initiation pressure sufficient to cause actuation of the packer elements 24. The metering module 30 slowly meters fluid into the annulus, thereby ramping up force to set packer shear events in the correct sequence. The final applied pressure may be the same as the initiation pressure.

Set forth below are some embodiments of the foregoing disclosure:

Embodiment 1

A setting tool configured to actuate a downhole component, comprising: an elongated inner tubular configured to be connected in fluid communication with a borehole string in a borehole in a resource bearing formation; a housing configured to define a first fluid chamber and a second fluid chamber therein, the first fluid chamber configured to be filled with a fluid, the second fluid chamber isolated from the first fluid chamber and in fluid communication with the inner tubular; a setting piston coupled to the housing and in pressure communication with the second fluid chamber; and a metering module coupled to the housing and disposed at an end of the first fluid chamber, the metering module including a fluid path in fluid communication with the first fluid chamber, the fluid path forming a restriction therein, and an outlet connected to the fluid path, the outlet configured to permit fluid in the first fluid chamber to exit the first fluid chamber; wherein the outlet is configured to be opened to permit fluid to flow out of the first chamber at a flow rate controlled by the restriction and reduce fluid pressure therein to generate a differential pressure between the first chamber and the second chamber, the differential pressure causing the setting piston to apply a gradually increasing force on the downhole component.

Embodiment 2

The setting tool of any prior embodiment, wherein the housing, the setting piston and the metering module are moveable in an axial direction along the inner tubular.

Embodiment 3

The setting tool of any prior embodiment, further comprising a dividing component fixedly disposed relative to the inner tubular, the dividing component configured to separate the first chamber from the second chamber and isolate the first chamber from the second chamber.

Embodiment 4

The setting tool of any prior embodiment, wherein the downhole component includes a first component configured to be actuated at a first force level, and a second component configured to be actuated at a second force level, the second force level being greater than the first force level.

Embodiment 5

The setting tool of any prior embodiment, wherein the setting tool is configured to gradually increase the force to the first force level and actuate the first component, and continue thereafter to gradually increase the force to the second level to actuate the second component.

Embodiment 6

The setting tool of any prior embodiment, wherein the downhole component is a packer assembly.

Embodiment 7

The setting tool of any prior embodiment, wherein the outlet is configured to be opened by increasing pressure in the inner tubular to a selected fluid pressure.

Embodiment 8

The setting tool of any prior embodiment, wherein metering module includes a rupture disk configured to be ruptured at the selected fluid pressure to open the outlet.

Embodiment 9

The setting tool of any prior embodiment, wherein the outlet is configured to be opened in conjunction with increasing fluid pressure in the inner tubular to an initiation pressure, the initiation pressure being a pressure sufficient to cause the setting tool to actuate the downhole component.

Embodiment 10

The setting tool of any prior embodiment, wherein the fluid pressure in the inner tubular is configured to be maintained at initiation pressure as the setting piston applies the gradually increasing force to the downhole component.

Embodiment 11

A method of actuating a downhole component, comprising: deploying a borehole string including the downhole component and a setting tool in a borehole in a resource bearing formation, the setting tool including: an elongated inner tubular in fluid communication with the borehole string; a housing configured to define a first fluid chamber and a second fluid chamber therein, the first fluid chamber filled with a fluid, the second fluid chamber isolated from the first fluid chamber and in fluid communication with the inner tubular; a setting piston coupled to the housing and in pressure communication with the second fluid chamber; and a metering module coupled to the housing and disposed at an end of the first fluid chamber, the metering module including a fluid path in fluid communication with the first fluid chamber, the fluid path forming a restriction therein, and an outlet connected to the fluid path, the outlet configured to permit fluid in the first fluid chamber to exit the first fluid chamber; circulating borehole fluid through the borehole string and an annulus of the borehole; increasing fluid pressure in the inner tubular and opening the outlet, wherein opening the outlet permits fluid to flow out of the first chamber at a flow rate controlled by the restriction and reduce fluid pressure in the first chamber; and generating a differential pressure between the first chamber and the second chamber due to a decrease in fluid pressure in the first chamber, the differential pressure causing the setting piston to apply a gradually increasing force on the downhole component.

Embodiment 12

The method of any prior embodiment, wherein the housing, the setting piston and the metering module are moveable in an axial direction along the inner tubular.

Embodiment 13

The method of any prior embodiment, wherein the setting tool includes a dividing component fixedly disposed relative to the inner tubular, the dividing component configured to separate the first chamber from the second chamber and isolate the first chamber from the second chamber.

Embodiment 14

The method of any prior embodiment, wherein the downhole component includes a first component configured to be actuated at a first force level, and a second component configured to be actuated at a second force level, the second force level being greater than the first force level.

Embodiment 15

The method of any prior embodiment, wherein generating the differential pressure includes gradually increasing the force to the first force level to actuate the first component, and thereafter gradually increasing the force to the second level to actuate the second component.

Embodiment 16

The method of any prior embodiment, wherein the downhole component is a packer assembly.

Embodiment 17

The method of any prior embodiment, wherein the outlet is opened by increasing pressure in the inner tubular to a selected fluid pressure.

Embodiment 18

The method of any prior embodiment, wherein metering module includes a rupture disk configured to be ruptured at the selected fluid pressure to open the outlet.

Embodiment 19

The method of any prior embodiment, wherein the outlet is configured to be opened in conjunction with increasing fluid pressure in the inner tubular to an initiation pressure, the initiation pressure being a pressure sufficient to cause the setting tool to actuate the downhole component.

Embodiment 20

The method of any prior embodiment, wherein the fluid pressure in the inner tubular is maintained at the initiation pressure as the setting piston applies the gradually increasing force to the downhole component.

In support of the teachings herein, various analysis components may be used, including a digital and/or an analog system. For example, embodiments such as the system 10, downhole tools, hosts and network devices described herein may include digital and/or analog systems. Embodiments may have components such as a processor, storage media, memory, input, output, wired communications link, user interfaces, software programs, signal processors (digital or analog), signal amplifiers, signal attenuators, signal converters and other such components (such as resistors, capacitors, inductors and others) to provide for operation and analyses of the apparatus and methods disclosed herein in any of several manners well-appreciated in the art. It is considered that these teachings may be implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A setting tool configured to actuate a downhole component, comprising:

an elongated inner tubular configured to be connected in fluid communication with a borehole string in a borehole in a resource bearing formation;

a housing configured to define a first fluid chamber and a second fluid chamber therein, the first fluid chamber configured to be filled with a fluid, the second fluid chamber isolated from the first fluid chamber and in fluid communication with the inner tubular;

a setting piston coupled to the housing and in pressure communication with the second fluid chamber; and a metering module coupled to the housing and disposed at an end of the first fluid chamber, the metering module including a fluid path in fluid communication with the first fluid chamber, the fluid path forming a restriction therein, and an outlet connected to the fluid path, the outlet configured to permit fluid in the first fluid chamber to exit the first fluid chamber;

wherein the outlet is configured to be opened to initiate actuation of the downhole component and to permit fluid to flow out of the first chamber during the actuation at a flow rate controlled by the restriction and reduce fluid pressure therein to generate a differential pressure between the first chamber and the second chamber, the differential pressure causing the setting piston to apply a gradually increasing force on the downhole component.

2. The setting tool of claim 1, wherein the housing, the setting piston and the metering module are moveable in an axial direction along the inner tubular.

3. The setting tool of claim 2, further comprising a dividing component fixedly disposed relative to the inner tubular, the dividing component configured to separate the first chamber from the second chamber and isolate the first chamber from the second chamber.

4. The setting tool of claim 2, wherein the downhole component includes a first component configured to be actuated at a first force level, and a second component configured to be actuated at a second force level, the second force level being greater than the first force level.

5. The setting tool of claim 4, wherein the setting tool is configured to gradually increase the force to the first force level and actuate the first component, and continue thereafter to gradually increase the force to the second level to actuate the second component.

6. The setting tool of claim 1, wherein the downhole component is a packer assembly.

7. The setting tool of claim 1, wherein the outlet is configured to be opened by increasing pressure in the inner tubular to a selected fluid pressure.

8. The setting tool of claim 7, wherein metering module includes a rupture disk configured to be ruptured at the selected fluid pressure to open the outlet.

9. The setting tool of claim 1, wherein the outlet is configured to be opened in conjunction with increasing fluid pressure in the inner tubular to an initiation pressure, the initiation pressure being a pressure sufficient to cause the setting tool to actuate the downhole component.

10. The setting tool of claim 9, wherein the fluid pressure in the inner tubular is configured to be maintained at initiation pressure as the setting piston applies the gradually increasing force to the downhole component.

11. A method of actuating a downhole component, comprising:

deploying a borehole string including the downhole component and a setting tool in a borehole in a resource bearing formation, the setting tool including:

an elongated inner tubular in fluid communication with the borehole string;

a housing configured to define a first fluid chamber and a second fluid chamber therein, the first fluid chamber filled with a fluid, the second fluid chamber isolated from the first fluid chamber and in fluid communication with the inner tubular;

a setting piston coupled to the housing and in pressure communication with the second fluid chamber; and a metering module coupled to the housing and disposed at an end of the first fluid chamber, the metering module including a fluid path in fluid communication with the first fluid chamber, the fluid path forming a restriction therein, and an outlet connected to the fluid path, the outlet configured to permit fluid in the first fluid chamber to exit the first fluid chamber;

circulating borehole fluid through the borehole string and an annulus of the borehole;

initiating actuation of the downhole component by increasing fluid pressure in the inner tubular and opening the outlet, wherein opening the outlet permits fluid to flow out of the first chamber during the actuation at a flow rate controlled by the restriction and reduce fluid pressure in the first chamber; and generating a differential pressure between the first chamber and the second chamber due to a decrease in fluid pressure in the first chamber, the differential pressure causing the setting piston to apply a gradually increasing force on the downhole component.

12. The method of claim 11, wherein the housing, the setting piston and the metering module are moveable in an axial direction along the inner tubular.

13. The method of claim 12, wherein the setting tool includes a dividing component fixedly disposed relative to the inner tubular, the dividing component configured to separate the first chamber from the second chamber and isolate the first chamber from the second chamber.

14. The method of claim 12, wherein the downhole component includes a first component configured to be actuated at a first force level, and a second component configured to be actuated at a second force level, the second force level being greater than the first force level.

15. The method of claim 14, wherein generating the differential pressure includes gradually increasing the force to the first force level to actuate the first component, and thereafter gradually increasing the force to the second level to actuate the second component.

16. The method of claim 11, wherein the downhole component is a packer assembly.

17. The method of claim 11, wherein the outlet is opened by increasing pressure in the inner tubular to a selected fluid pressure.

18. The method of claim 17, wherein metering module includes a rupture disk configured to be ruptured at the selected fluid pressure to open the outlet.

19. The method of claim 11, wherein the outlet is configured to be opened in conjunction with increasing fluid pressure in the inner tubular to an initiation pressure, the initiation pressure being a pressure sufficient to cause the setting tool to actuate the downhole component.

20. The method of claim 19, wherein the fluid pressure in the inner tubular is maintained at the initiation pressure as the setting piston applies the gradually increasing force to the downhole component.

* * * * *